US008506331B2

(12) United States Patent
Wu

(10) Patent No.: US 8,506,331 B2
(45) Date of Patent: Aug. 13, 2013

(54) ELECTRICAL CONNECTOR ASSEMBLY WITH EXTERNAL METALLIC GASKET

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/400,006

(22) Filed: Feb. 17, 2012

(65) Prior Publication Data

US 2012/0214324 A1 Aug. 23, 2012

(30) Foreign Application Priority Data

Feb. 18, 2011 (CN) ..... 2011 1 0040766

(51) Int. Cl.
*H01R 13/648* (2006.01)

(52) U.S. Cl.
USPC ..... 439/607.18; 439/76.1; 439/353

(58) Field of Classification Search
USPC ..... 439/76.1, 607.17–607.21, 353
See application file for complete search history.

(56) References Cited

U.S. PATENT DOCUMENTS 7,160,135 B1 * 1/2007 Wu ..... 439/352
7,281,937 B2 10/2007 Molex
7,618,264 B2 * 11/2009 Wu ..... 439/76.1
7,651,341 B2 * 1/2010 Wu ..... 439/76.1
7,651,342 B1 * 1/2010 Wu ..... 439/76.1
7,654,831 B1 * 2/2010 Wu ..... 439/76.1
7,803,010 B1 * 9/2010 Hwang ..... 439/497
7,883,341 B2 * 2/2011 Lang et al. ..... 439/76.1
7,938,669 B2 * 5/2011 Li et al. ..... 439/352
8,147,255 B2 * 4/2012 Wu ..... 439/76.1
8,152,555 B2 * 4/2012 Wu ..... 439/352
8,157,579 B2 * 4/2012 Wu ..... 439/352
8,157,580 B2 * 4/2012 Wu ..... 439/352
8,202,122 B2 * 6/2012 Wu ..... 439/607.47
8,241,045 B2 * 8/2012 Reed et al. ..... 439/76.1
8,251,730 B2 * 8/2012 Wu ..... 439/345
8,251,733 B2 * 8/2012 Wu ..... 439/352
8,251,735 B2 * 8/2012 Wu ..... 439/353
8,267,713 B2 * 9/2012 Wu ..... 439/352
8,292,637 B2 * 10/2012 Wu ..... 439/76.1
8,303,314 B2 * 11/2012 Wu ..... 439/76.1
8,337,233 B2 * 12/2012 Wu ..... 439/345
8,360,799 B2 * 1/2013 Wu ..... 439/358
8,366,456 B2 * 2/2013 Wu ..... 439/76.1
8,393,913 B2 * 3/2013 Wu ..... 439/345
2009/0253292 A1 * 10/2009 Wu ..... 439/493
2010/0015851 A1 * 1/2010 Wu ..... 439/607.01
2010/0130063 A1 * 5/2010 Lang et al. ..... 439/607.17
2011/0059645 A1 * 3/2011 Wu ..... 439/460
2011/0086548 A1 * 4/2011 Wu ..... 439/607.41
2011/0136368 A1 * 6/2011 Wu ..... 439/345

(Continued)

*Primary Examiner* — Ross Gushi
(74) *Attorney, Agent, or Firm* — Ming Chieh Chang; Wei Te Chung

(57) ABSTRACT

An electrical connector assembly (100) including: a housing (1) having an upper shield part (15) and a lower shield part (16) engaged with each other to form a rear body portion (12) and a front mating portion (13). Two printed circuit boards (2) are positioned in the housing. A spacer (3) is sandwiched between the two printed circuit boards. A metallic holder (8) surrounds the body portion of the housing. A metallic gasket (9) surrounds a rear section of the mating portion and located adjacent to the body portion. Each of the upper and lower shield parts has a first post positioning (154, 162) a corresponding one of the two printed circuit boards and a second post positioning (155, 163) the two printed circuit boards and the spacer.

17 Claims, 11 Drawing Sheets

U.S. PATENT DOCUMENTS

2011/0183535 A1* 7/2011 Wu ..... 439/153
2011/0195586 A1* 8/2011 Wu ..... 439/152
2011/0195590 A1* 8/2011 Wu ..... 439/345
2011/0195595 A1* 8/2011 Wu ..... 439/370
2011/0195614 A1* 8/2011 Wu ..... 439/676
2011/0212643 A1* 9/2011 Reed et al. ..... 439/345
2011/0223809 A1* 9/2011 Reed et al. ..... 439/626
2011/0237112 A1* 9/2011 Wu ..... 439/358
2011/0250778 A1* 10/2011 Wu ..... 439/345
2011/0256776 A1* 10/2011 Reed ..... 439/660
2011/0281455 A1* 11/2011 Wu ..... 439/345
2011/0294333 A1* 12/2011 Wu ..... 439/345
2011/0300735 A1* 12/2011 Wu ..... 439/345
2011/0306228 A1* 12/2011 Wu ..... 439/345
2012/0015544 A1* 1/2012 Wu ..... 439/345
2012/0015545 A1* 1/2012 Wu ..... 439/345
2012/0040550 A1* 2/2012 Wu ..... 439/352
2012/0040551 A1* 2/2012 Wu ..... 439/358
2012/0040552 A1* 2/2012 Wu ..... 439/358
2012/0064750 A1* 3/2012 Wu ..... 439/345
2012/0094515 A1* 4/2012 Wu ..... 439/159
2012/0129396 A1* 5/2012 Wang et al. ..... 439/607.01
2012/0164860 A1* 6/2012 Wang et al. ..... 439/159
2012/0190223 A1* 7/2012 Wu ..... 439/152
2012/0190224 A1* 7/2012 Wu ..... 439/157
2012/0214324 A1* 8/2012 Wu ..... 439/271
2012/0214345 A1* 8/2012 Wu ..... 439/607.19
2012/0214350 A1* 8/2012 Wu ..... 439/676
2012/0220152 A1* 8/2012 Wu ..... 439/350

* cited by examiner

ELECTRICAL CONNECTOR ASSEMBLY WITH EXTERNAL METALLIC GASKET

FIELD OF THE INVENTION

The present invention generally relates to connectors suitable for transmitting data, more specifically to input/output (I/O) connectors with high-density configuration and high data transmitting rate.

DESCRIPTION OF PRIOR ART

U.S. Pat. No. 7,281,937 issued to Reed et al. on Oct. 16, 2007 discloses a plug connector. The plug connector defines a body portion and a mating portion extending forwardly from a front face of the body portion and having a groove thereon. An elastomeric ring gasket is received into the groove of the mating portion and it encircles and sits thereon near the front face of body portion to provide a seal against EMI radiation when in use. U.S. Patent Application Publication No. 2010/0130063 to Lang et al. published on May 27, 2010 also discloses a plug connector with an elastomeric ring gasket formed thereon to provide anti-EMI function, as well as internal circuit card support means. The plug connector defines a larger body portion and a smaller mating portion. The elastomeric ring gasket also encircles the smaller mating portion. The gasket is formed from a continuous band of elastomeric material that contains conductive matter so as to render it conductive in ways known in the art. U.S. Patent Application Publication No. 2011/0256776 to Reed et al. published on Oct. 20, 2011 also relates to a similar type of connector, further disclosing a fastening clip for retaining two housing halves.

An electrical connector having improved internal circuit card or board supporting structure is desired.

SUMMARY OF THE INVENTION

Accordingly, an object of the present invention is to provide an electrical connector assembly with high-density configuration and high data transmitting rate, and with anti-EMI function.

In order to achieve the above-mentioned objects, an electrical connector assembly comprises: a housing having an upper shield part and a lower shield part engaged with each other to form a rear body portion and a front mating portion; two printed circuit boards positioned in the housing; a spacer sandwiched between the two printed circuit boards; a metallic holder surrounding the body portion of the housing; and a metallic gasket surrounding a rear section of the mating portion and located adjacent to the body portion, wherein each of the upper and lower shield parts has a first post positioning a corresponding one of the two printed circuit boards and a second post positioning the two printed circuit boards and the spacer.

Other objects, features and advantages of the invention will be apparent from the following detailed description taken in connection with the accompanying drawings.

DETAILED DESCRIPTION OF PREFERRED EMBODIMENTS

Figure 1:
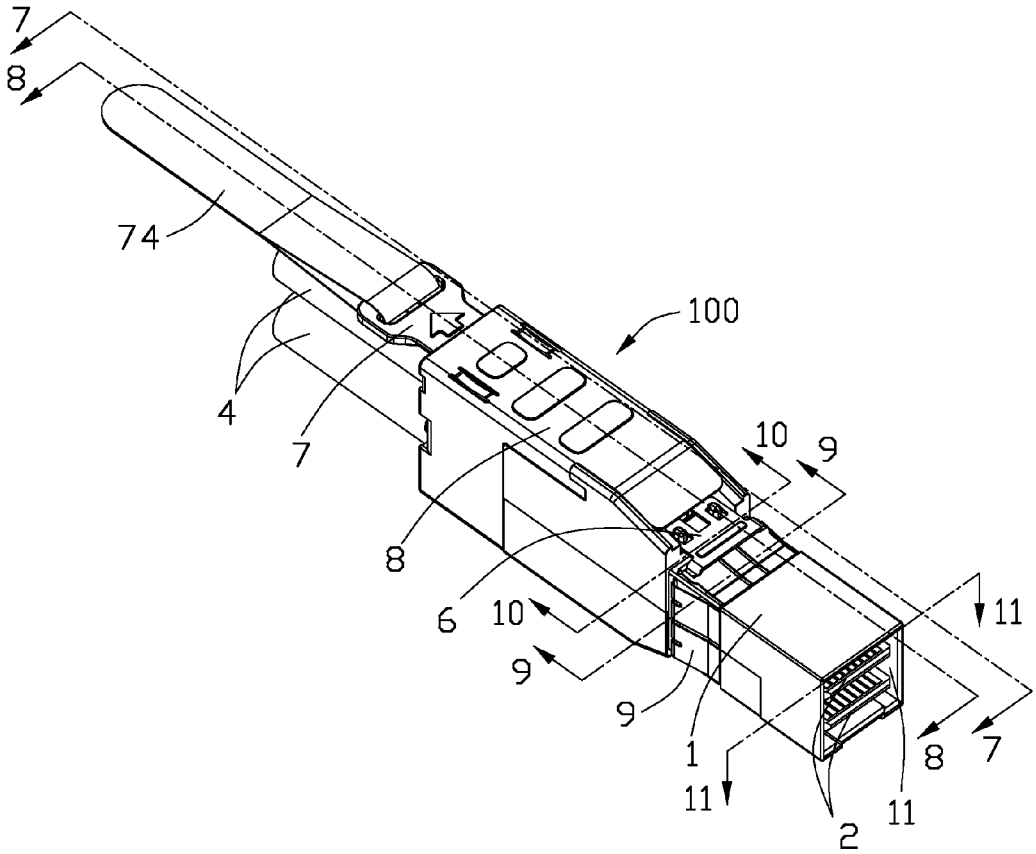
FIG. 1 is a perspective view of an electrical connector assembly in accordance with the present invention.
Figure 2:
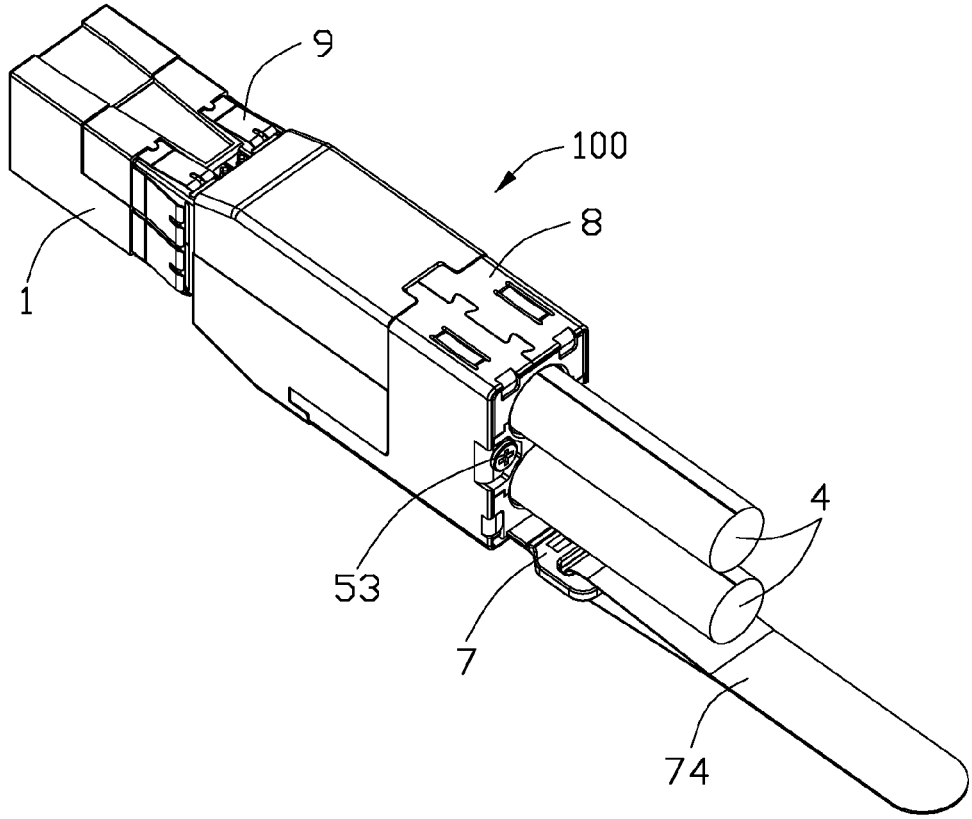
FIG. 2 is another perspective view of the electrical connector assembly of FIG. 1.

Reference will now be made to the drawing figures to describe the present invention in detail.

Figure 7:
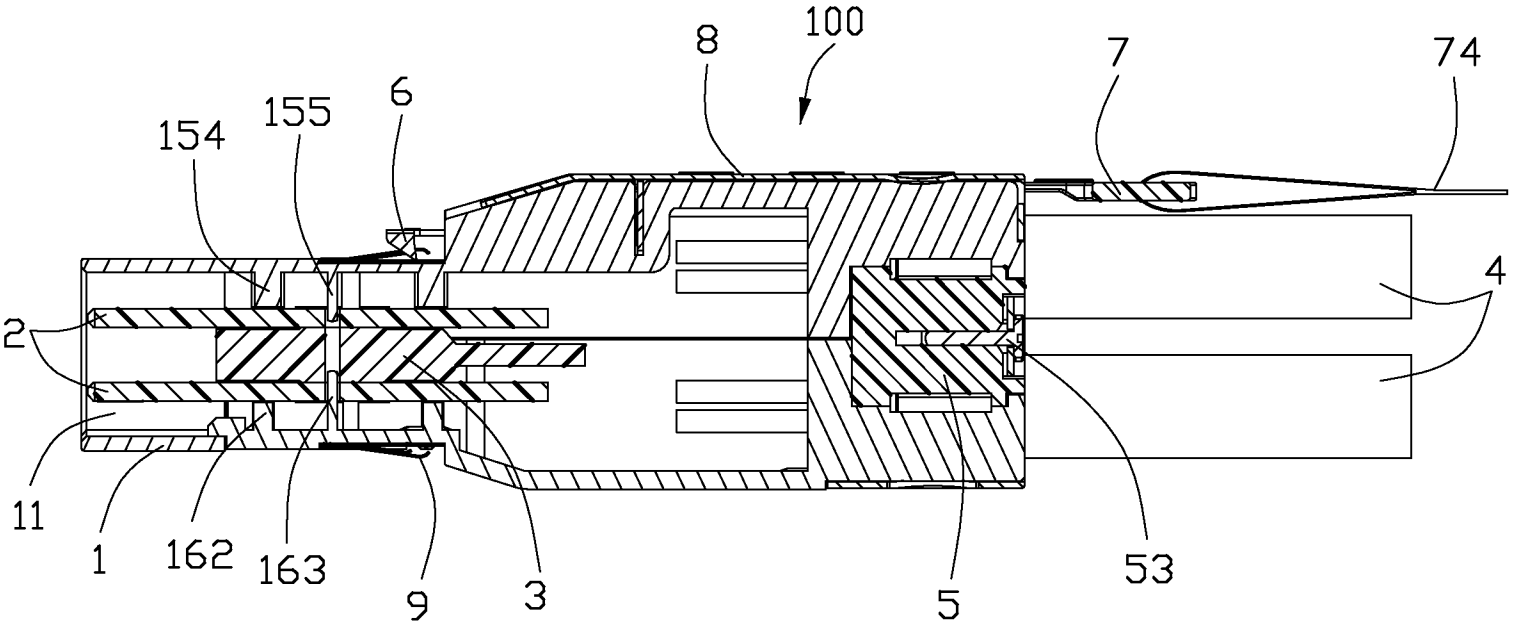
FIG. 7 is a cross section view of the electrical connector assembly of FIG. 1 taken along line 7-7.

FIGS. 1 to 4 illustrate perspective views of an electrical connector assembly 100 made in accordance with the present invention. And in conjunction with FIGS. 7 to 8, the electrical connector assembly 100 comprises a housing 1 having a receiving room 11 therein, two paralleled printed circuit boards (PCBs) 2 positioned in the receiving room 11, a spacer 3 disposed between the two printed circuits boards 2 and positioned with the housing 1, two cables 4 respectively electrically connected with two printed circuit boards 2 and a strain relief 5 disposed in the housing 1 and spaced apart with the two cables 4 along a vertical direction. The electrical connector assembly 100 further comprises a latch mechanism assembled to a top surface of the housing 1 and a metallic holder 8 surrounding a portion of the housing 1 and the latch mechanism. The latch mechanism comprises a latching member 6 and a pulling member 7 interconnected with each other. The electrical connector assembly 100 further comprises a metallic gasket 9 surrounding a front portion of the housing 1.

Referring to FIGS. 1 to 6, the housing 1 is made of metallic material and formed in a die-cast manner. The housing 1 defines a body portion 12 and a mating portion 13 extending forward from the body portion 12 for mating to a complementary connector (not shown). The body portion 12 has a cross section larger than that of mating portion 13. The housing 1 defines a receiving room 11 extending rearward from a front surface to a rear surface thereof. The body portion 12 of the housing 1 defines a top surface 121. The mating portion 13 of the housing 1 also defines a top surface 131. The top surface 121 is disposed above the top surface 131. The body portion 12 defines a receiving cavity 14 extending downwardly from the top surface 121 for a distance and located on a front end of the body portion 12. The receiving cavity 14 has a bottom surface 141 located on a same level with the top face 131. In addition, a pair of supporting posts 143 are formed on two inner side surfaces of the receiving cavity 14 for supporting a front end of the connecting section 72 of the pulling member 7. The mating portion 13 of the housing 1 defines a recessed area 132 formed on an outer surface and located adjacent to a front surface of the body portion 12 for receiving the metallic gasket 9.

Referring to FIGS. 1 to 6, the housing 1 comprises a first shield part 15 and a second shield part 16 assembled with each other along a vertical direction. The first shield part 15 and the second shield part 16 are mated with each other along a horizontal plane. The first shield part 15 defines a rectangular frame 151 formed at a front end thereof and defined as a mating port of the housing 1. The first shield part 15 further defines a top wall (not labeled) extending rearwardly from the rectangular frame 151 and a pair of side walls (not labeled) extending downwardly from two sides of the top wall.

Figure 3:
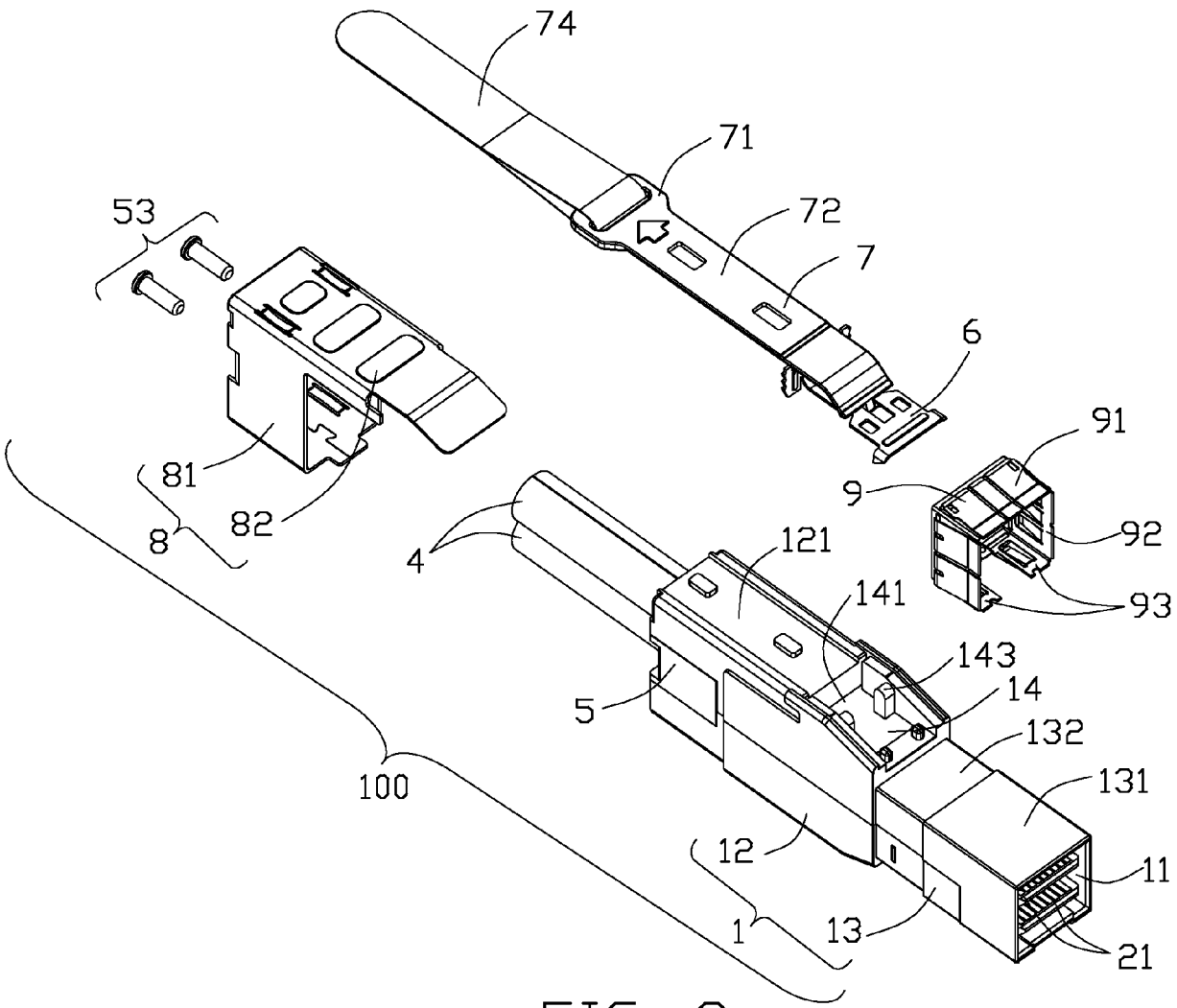
FIG. 3 is a partial exploded, perspective view of the electrical connector assembly of FIG. 1.
Figure 4:
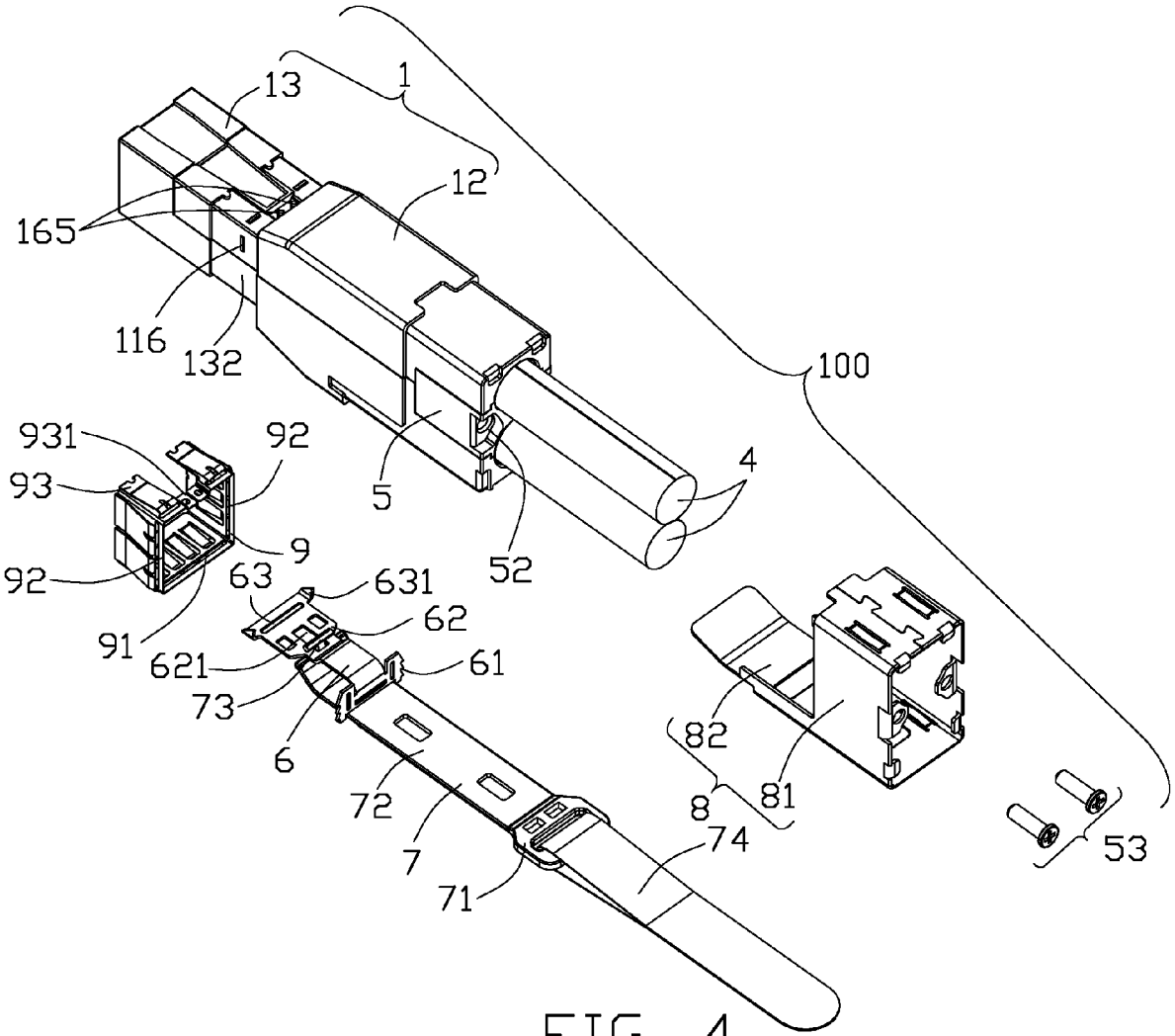
FIG. 4 is a partial exploded, perspective view of the electrical connector assembly of FIG. 2.

Referring to FIGS. 3 to 4, the first shield part 15 defines a first receiving passage 153 extending along a front-to-rear direction and communicated with an exterior along a downward direction. Further, the first shield part 15 defines two first positioning posts 154 formed on an inner side surface thereof and another two first positioning posts 154 formed on another inner side surface thereof. Each of two first positioning posts 154 are spaced apart with each other along a front-to-rear direction. Each first positioning post 154 has a semi-circular cross section. The first positioning posts 154 are used for supporting the printed circuit board 2 along an up-to-down direction. In addition, two second positioning posts 155 are respectively formed on two inner side surface of the first shield part 15. Each second positioning post 155 is disposed between the two first positioning posts 154 along a front-to-rear direction for limiting a movement of the printed circuit board 2 along a front to rear direction. Each second positioning post 155 also has a semi-circular cross section. And, the second positioning post 155 is longer than the first positioning post 154 along a vertical direction. The first shield part 15 defines a first depressed section 156 formed on an outer surface of a front portion of the first shield part 15.

Referring to FIGS. 3 to 4, the second shield part 16 is structured in a cover shape and defines a bottom wall (not labeled) and a pair of side walls (not labeled) extending upwardly from two sides of the bottom wall. The second shield part 16 defines a second receiving passage 161 formed therein and extending along a front-to-rear direction. The second shield part 16 also defines two first positioning posts 162 and a second positioning post 163 on an inner side surface of the second receiving passage 161. The second shield part 16 defines another two first positioning posts 162 and a second positioning post 163 on another inner side surface of the second receiving passage 161. Each second positioning post 163 is disposed between two first positioning posts 162 along a front-to-rear direction. The first positioning posts 162 are used for supporting the printed circuit board 2 along an up-to-down direction. The second positioning posts 163 are used for limiting a movement of the printed circuit board 2 along a front to rear direction. The second shield part 16 also defines a second depressed section 164 formed on an outer surface of a front portion of the second shield part 16. The recessed area 132 formed on an outer surface of the mating portion 13 is composed by the first depressed section 156 and the second depressed section 164. A pair of positioning sections 165 are formed in the second depressed section 164 to engage with two free ends of the metallic gasket 9. In this embodiment, the pair of positioning sections 165 are designed to two pins. A plurality of ribs 166 are formed in the recessed area 132 for engaging with the metallic gasket 9.

Figure 5:
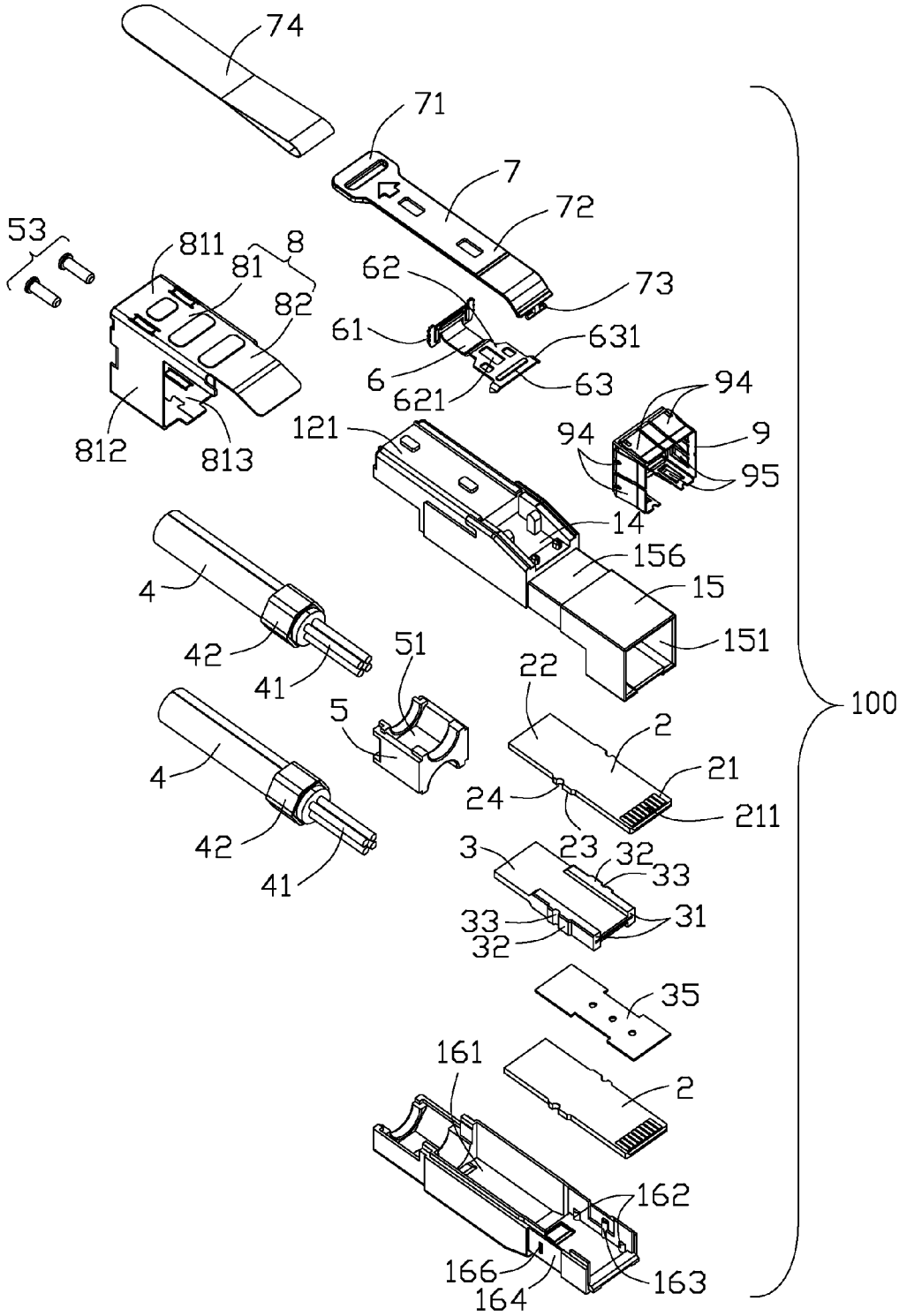
FIG. 5 is an exploded, perspective view of the electrical connector assembly of FIG. 1.
Figure 6:
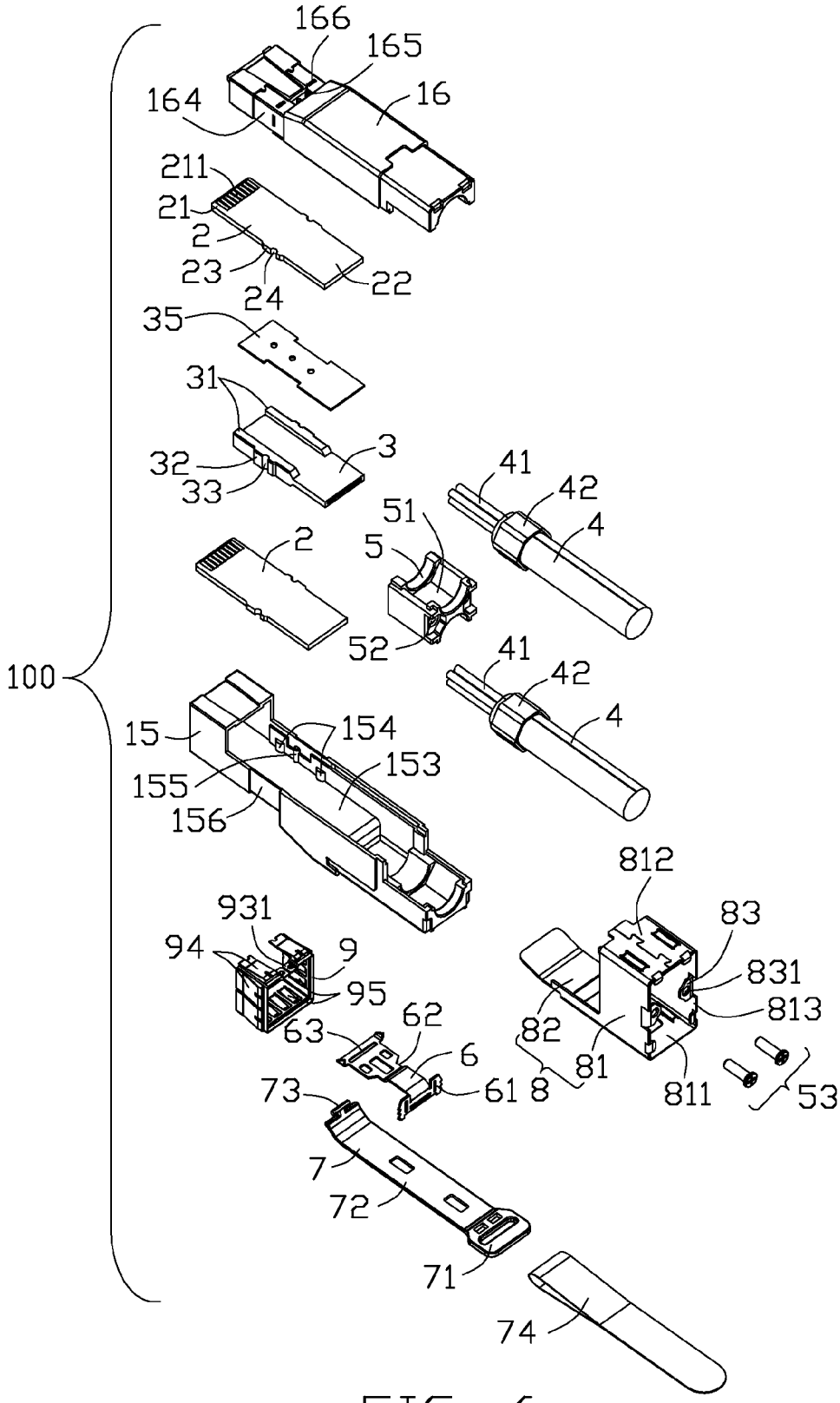
FIG. 6 is an exploded, perspective view of the electrical connector assembly of FIG. 2.
Figure 8:
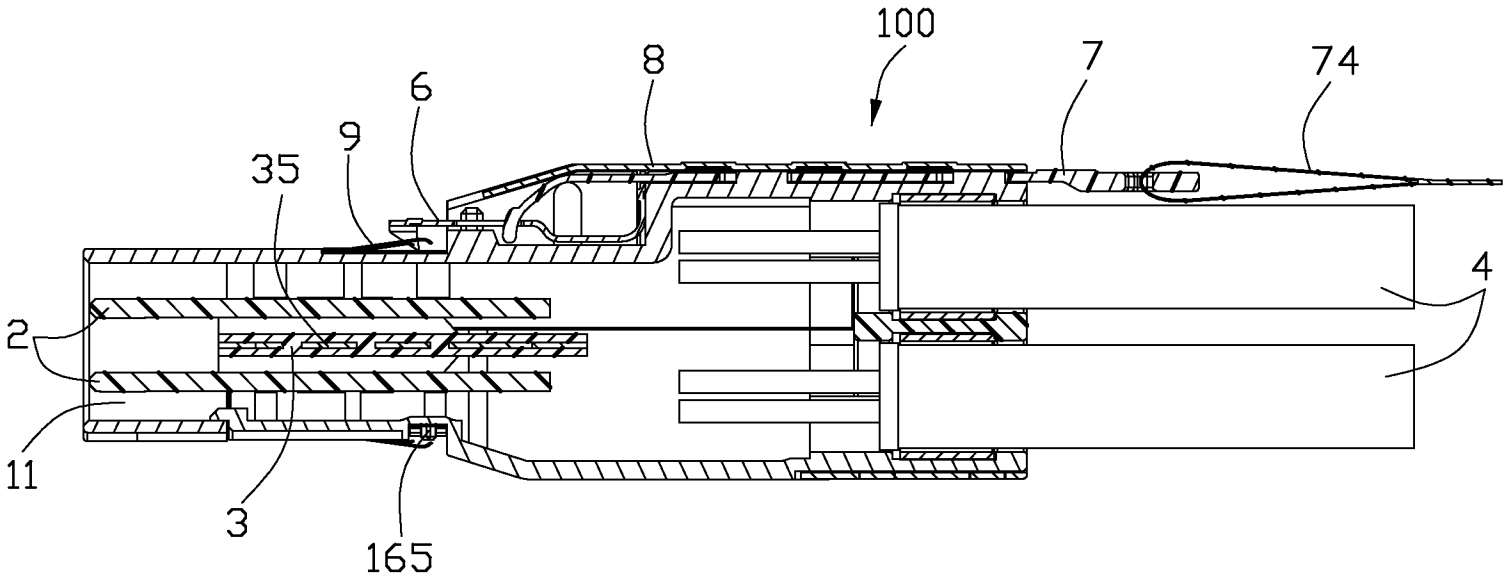
FIG. 8 is a cross section view of the electrical connector assembly of FIG. 1 taken along line 8-8.

Referring to FIGS. 5 to 6 and in conjunction with FIG. 8, two printed circuit boards 2 are received into the receiving room 11 of the housing 1. Each of the printed circuit board 2 defines a front mating section 21 and a rear terminating section 22. The mating section 21 defines a plurality of conductive pads 211 formed on a top and bottom surfaces thereof. The terminating section 22 also defines a plurality of conductive pads (not shown) formed on a top and bottom surfaces thereof. And, each of the printed circuit board 2 defines two projections 23 extending outwardly from two sides thereof. Each projection 23 defines a cutout 24 cooperating with a second positioning post 155, 163. Thus, the two printed circuit boards 2 are respectively limited by the two second positioning posts 155, 163 along a front-to-rear direction.

Referring to FIGS. 5 to 8, the spacer 3 is formed of insulative material and defines a top surface and a bottom surface. The spacer 3 defines a pair of ribs 31 respectively formed at two sides of the top surface and another pair of ribs 31 respectively formed at two sides of the bottom surface for supporting two printed circuit boards 2. Two projections 32 are respectively formed at two sides of the spacer 3. The spacer 3 further defines a pair of grooves 33 respectively formed on the two projections 32 extending along a vertical direction for cooperating with the two second positioning posts 155, 163. The spacer 3 further defines a grounding plate 35 integrative formed therein.

Referring to FIGS. 5 and 6, each of the cable 4 has a plurality of conductors 41 electrically connected to the terminating section 22 of the printed circuit board 2. And, a ring 42 is surrounded to an outer surface of the cable 4.

Referring to FIGS. 3 to 7, a strain relief 5 is made of metallic material and disposed in a rear section of the receiving room 11 of the housing 1. The strain relief 5 has two recesses 51 respectively formed on a top and bottom surfaces thereof for receiving a portion of the two rings 42. The strain relief 5 defines a pair of receiving holes 52 formed on a rear surface thereof for receiving a pair of engaging pieces 53.

Referring to FIGS. 3 to 6, the latching member 6 is stamped and formed from a metallic plate and comprises a vertical retaining portion 61, a connecting portion 62 extending forwardly from a bottom side of the retaining portion 61 and a latching portion 63 extending forwardly from the connecting portion 62. A front portion of the latch 6 is defined as a latching portion 63. The retaining portion 61 defines a plurality of sharp projections 611 formed at two sides thereof. The connecting portion 62 defines a rectangular hole 621 for a front end of the pulling member 7 passing through. The latching portion 63 defines a pair of barbs 631 formed at two sides thereof.

Referring to FIGS. 3 to 6, the pulling member 7 is made of insulative material and structured in a flat shape. The pulling member 7 defines a T-shape actuating section 73, a rear operating section 71 and a connecting section 72 connecting the actuating section 73 and the rear operating section 71. A tape 74 is connected to a rear end of the actuating section 73 of the pulling member 7.

Referring to FIGS. 1 to 6, the metallic holder 8 defines a main portion 81 binding the first shield part 15 and the second shield part 16 together and a shielding portion 82 shielding a portion of the body portion 12. The main portion 81 is structured in a rectangular frame shape and has a top wall 811, a bottom wall 812 and a pair of side walls 813 connected with the top wall 811 and the bottom wall 812. The shielding portion 82 extends forwardly and downwardly from the top wall 811. Each side wall 813 defines a tab 83 extending inwardly from a rear edge thereof. And, the tab 83 is perpendicular to the side wall 813 and defines a through hole 831 in alignment with a receiving hole 52 of the strain relief 5 along a front-to-rear direction. The top wall 811 and the bottom wall 812 respectively has two spring tabs (not labeled) to hold the first shield part 15 and second shield part 16 along a vertical direction.

Referring to FIGS. 1 to 7, two engaging pieces 53 are assembled to the strain relief 5. In this embodiment, the engaging piece 53 is a screw. Two screws 53 are passed through the two through holes 831 and received into the receiving holes 52 to interlock the metallic holder 8 and the strain relief 5. As the strain relief 5 is disposed in the housing 1, so the metallic holder 8 is indirectly positioned with the housing 1 through the screws 53.

Figure 9:
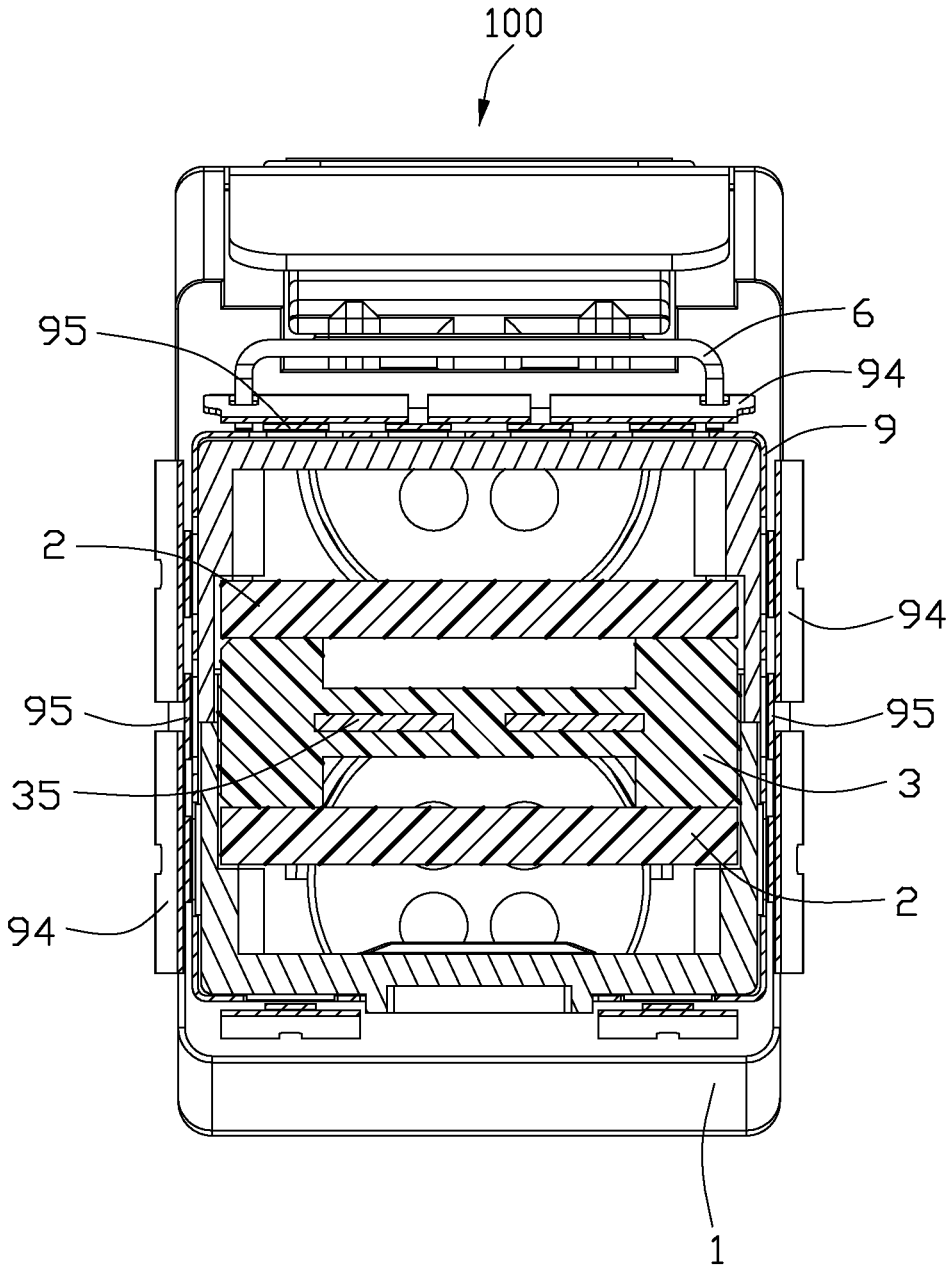
FIG. 9 is a cross section view of the electrical connector assembly of FIG. 1 taken along line 9-9.
Figure 10:
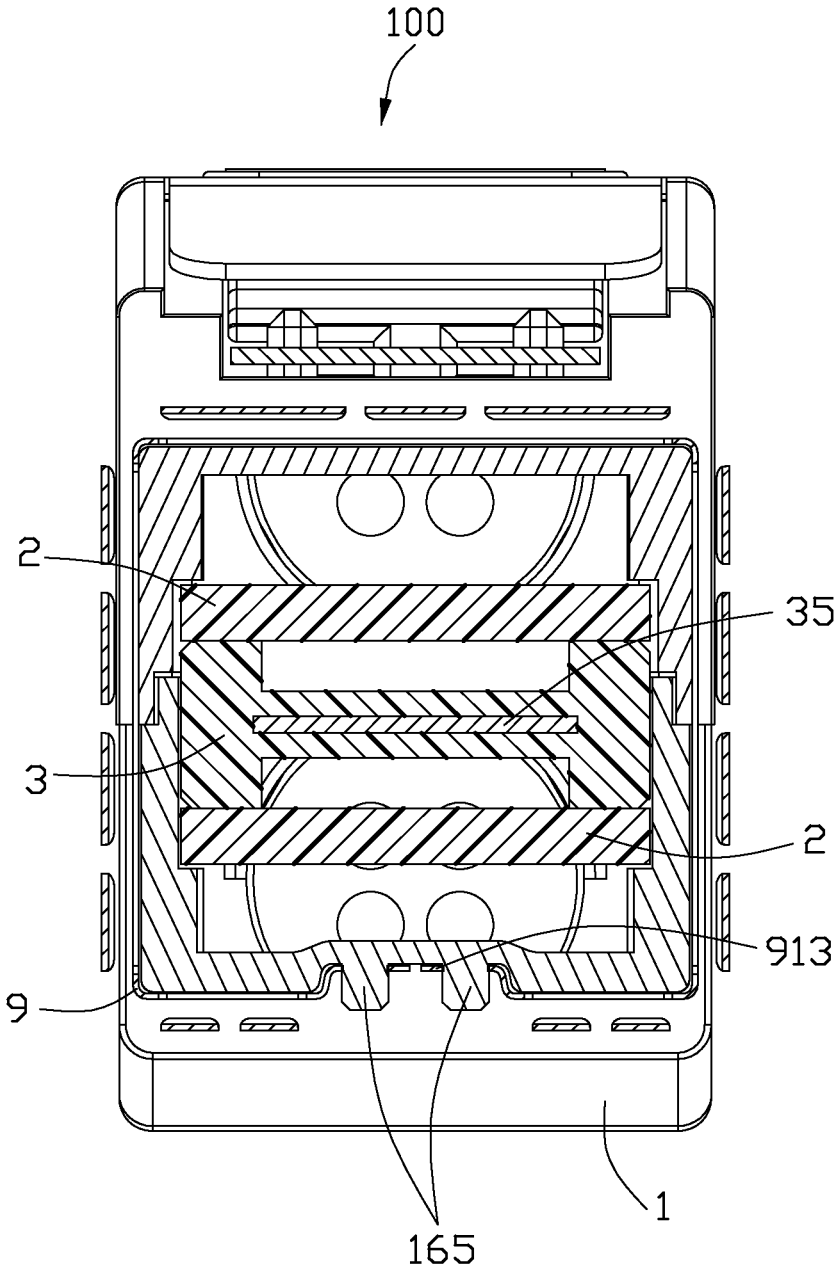
FIG. 10 is a cross section view of the electrical connector assembly of FIG. 1 taken along line 10-10.
Figure 11:
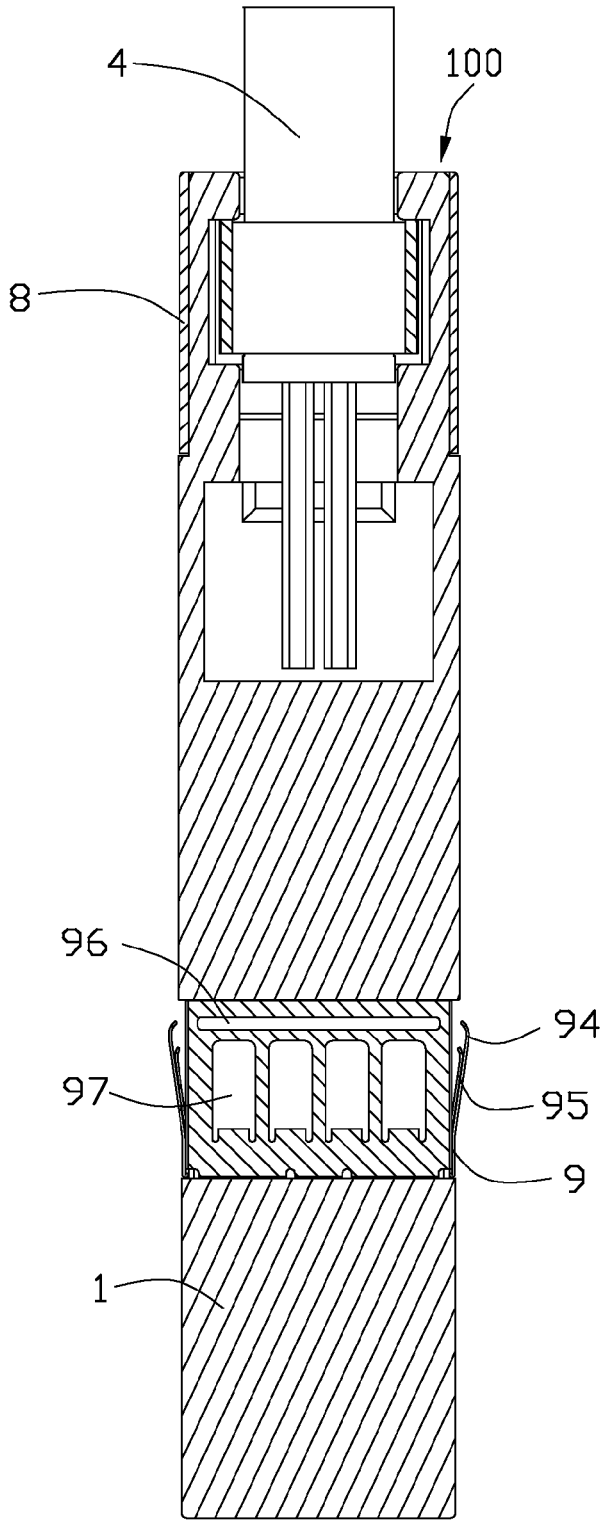
FIG. 11 is a cross section view of the electrical connector assembly of FIG. 1 taken along line 11-11.

Referring to FIGS. 1 to 6 and in conjunction with FIGS. 9 to 11, the metallic gasket 9 is made of metallic sheet and received into the recessed area 156, 164 of the mating portion 13 of the housing 1. The metallic gasket 9 is structured in a frame shape. The metallic gasket 9 defines a top wall 91, a pair of vertical walls 92 respectively extending downwardly from two edges of the top wall 91 and a pair of lower sub-walls 93 extending inwardly from two ends of the pair of vertical walls 92. A free end of each lower sub-wall 93 is defined as a connecting portion 931 engaged with a pin 165 of the housing 1. The metallic gasket 9 is firmly fixed to the housing 1 due to a connection between the connecting portion 931 and the positioning sections 165. The metallic sheet 9 defines a plurality of first fingers 94 and a plurality of second fingers 95 formed around the metallic sheet 9 and extending rearwardly and outwardly. The first and second fingers 94, 95 are both inclined and elastic. A plurality of second fingers 95 are located on an inner side of a plurality of first fingers 94. The metallic gasket 9 defines a plurality of rectangular holes 96 corresponding to a plurality of free ends of the first fingers 94 and a plurality of rectangular holes 97 corresponding to the plurality of second fingers 95. The rib 166 is disposed in the rectangular hole 97 to limited a movement of the metallic gasket 9 along a front to rear direction. And, it should be noted that each of the first finger 94 is overlapped with a corresponding second finger 95 in a vertical direction.

Referring to FIGS. 1 to 11, the assembling process of the electrical connector assembly 100 made in according to the present invention starts from soldering the conductors 41 of each cable 4 to the terminating section 22 of the printed circuit board 2. Thus, two combinations of the cable 4 and the printed circuit board 2 are accomplished.

Then, turn over the first shield part 15 to make the first receiving passage 153 facing upward and assembling a combination of the cable 4 and the printed circuit board 2 into the first receiving passage 153. The printed circuit board 2 is supported by the first positioning posts 154 along a vertical direction. The printed circuit board 2 is positioned with the first shield part 15 along a front-to-rear direction due to two cutouts 24 of the printed circuit board 2 cooperated with the pair of second positioning posts 155 of the first shield part 15. And, a front end of the cable 4 is supported by a rear end of the first shield part 15.

Then, assemble the strain relief 5 to a rear end of the first shield part 15. And, the ring 42 is sandwiched by the rear end of the first shield part 15 and the strain relief 5. Thus, the ring 42 is received into a room (not labeled) formed by the strain relief 5 and the first shield part 15.

Then, assemble the spacer 3 into the first receiving passage 153 of the first shield part 15 to make the two grooves 33 of the spacer 3 in alignment with the two second positioning posts 155. The spacer 3 is located on the printed circuit board 2.

Then, assemble another combination of the printed circuit board 2 and the cable 4 together to the first shield part 15. The printed circuit board 2 is located on the spacer 3. The mating section 21 of the printed circuit board 2 is received into the rectangular frame 151 of the first shield part 15. The two cutouts 24 of the printed circuit board 2 are in alignment with two grooves 33 of the spacer 3. The ring 42 of the cable is supported by the strain relief 5.

Then, assemble the second shield part 16 to the first shield part 15. Thus, the housing 1 is formed by the first shield part 15 and the second shield part 16. At this time, the first positioning posts 162 attach to the printed circuit board 2. And, the second positioning posts 163 are respectively passed through the two cutouts 24 of the printed circuit board 2 and two grooves 33 of the spacer 3 in turn. Thus, the printed circuit board 2 and the spacer 3 are positioned with the second shield part 16 along a front-to-rear direction. After, the second shield part 16 is assembled to the first shield part 15, the two printed circuit boards 2 and the spacer 3 are all positioned in the housing 1.

Then, assemble the metallic gasket 9 to the recessed area 132 of the housing 1. Two connecting portions 931 of metallic gasket 9 are respectively connected to the two positioning sections 165 of the housing 1. Thus, the metallic gasket 9 is firmly fixed to the housing 1.

Then, assemble the latching member 6 to the pulling member 7 together through following steps. Firstly, the latching member 6 is disposed in front of pulling member 7 and arranged perpendicular to the pulling member 7. Secondly, the actuating section 73 of the pulling member 7 is passed through the rectangular hole 621 of the latching member 6 and located below the latching member 6. Thirdly, the latching member 6 is rotated 90 degree to make the latching member 6 and the pulling member 6 arranged in line. Thus, the latching member 6 is interconnected with the pulling member 7. And, the latching member 6 is not easily discrete from the pulling member 7 due to the width of a free end of the actuating section 73 is wider than the rectangular hole 621. The actuating section 73 will be moved along an upward and rearward direction when the pulling member 7 is exerted by a horizontal force.

Then, assemble the latching member 6 and the pulling member 7 together to an exterior surface of housing 1. The connecting section 72 of the pulling member 7 is located on the top surface 121 of the body portion 12 of the housing 1. A front end of the connecting section 72 of the pulling member 7 is supported by the pair of supporting posts 143 extended into the receiving cavity 14. The operating section 71 of the pulling member 7 extends rearwardly beyond the rear surface of the housing 1. In addition, the latching member 6 is received into the receiving cavity 14. Thus, the actuating section 73 of the pulling member 7 is disposed between the latching member 6 and the bottom surface 141 of the receiving cavity 14. The retaining portion 61 of the latching member 6 is engaged with the housing 1. The connecting portion 62 of the latching member 6 is located above the bottom surface 141. The latching portion 63 extends forwardly and is located above the top surface 131 of the mating portion 13 of the housing 1. The latching portion 63 is cantilevered from the retaining portion 61. The pair of barbs 631 of the latching member 6 pass through the corresponding outer fingers 94 of the metallic gasket 9 in a vertical direction. When a rearward pulling force is exerted on a rear end of the pulling member 7 or the tape 74, the latching portion 63 of the latching member 6 will be raised up. When the rearward pulling force is released, the latching portion 63 of the latching member 6 will resume to an original state.

Finally, assemble a metallic holder 8 to the housing 1. The main portion 81 of the metallic holder 8 binds the first part 15, the second shield part 16 and a portion of the pulling member 7 together. The pulling member 7 can be moved along a front to rear direction relative to the housing 1 and limited by the metallic holder 8 along a vertical direction. The strain relief 5 is also limited in the housing 1 by the metallic holder 8 through the pair of screws 53. The rear end of the latching member 6 and the front end of the pulling member 7 are shielded by the shielding portion 82 of the metallic holder 8.

After the above assembling steps, the entire process of assembling of the electrical connector assembly 100 is finished. The metallic gasket 9 is firmly fixed to the housing 1 and will not be easily disengaged from the housing 1. If the housing 1 defines two or more mating portions, two adjacent metallic gasket 9 assembled to the two mating portions are not easily separated from the two mating portions due to the tight spacing therebetween. Thus, the electrical connector assembly 100 will achieve better EMI suppressing effect.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly comprising:

a housing having an upper shield part and a lower shield part engaged with each other to form a rear body portion and a front mating portion;

two printed circuit boards positioned in the housing;

a spacer sandwiched between the two printed circuit boards;

a metallic holder surrounding the body portion of the housing; and a metallic gasket surrounding a rear section of the mating portion and located adjacent to the body portion, wherein each of the upper and lower shield parts has a first post positioning the corresponding one of the two printed circuit boards, and a second post positioning the corresponding one of the two printed circuit boards and the spacer.

2. The electrical connector assembly as recited in claim 1, wherein the mating portion of the housing defines a recessed area formed on an outer surface thereof, and the metallic gasket is accommodated in the recessed area.

3. The electrical connector assembly as recited in claim 2, wherein the metallic gasket has two connecting portions, and the mating portion of the housing has two positioning sections formed in the recessed area and engaged with the two connecting portions.

4. The electrical connector assembly as recited in claim 1, further comprising a strain relief sandwiched by the upper and lower shield parts and surrounded by the metallic holder.

5. The electrical connector assembly as recited in claim 4, further comprising means for engaging the metallic holder to the strain relief.

6. The electrical connector assembly as recited in claim 1, further comprising a latch mechanism assembled to an exterior surface of the housing and limited by the metallic holder along a vertical direction.

7. The electrical connector assembly as recited in claim 1, wherein the gasket defines a plurality of first fingers and second fingers.

8. The electrical connector assembly as recited in claim 1, wherein the housing defines a mating port formed on a front end of the upper shield part.

9. The electrical connector assembly as recited in claim 1, wherein the first post supports the corresponding one of the two printed circuit boards so as to cooperate with the spacer to sandwich said corresponding one of the two printed circuit boards in a vertical direction, while the second post prevents both the spacer and the corresponding one of the two printed circuit boards from moving relative to the housing in a front-to-back direction perpendicular to said vertical direction.

10. An electrical connector assembly comprising:

a metallic housing comprising an upper shield part and a lower shield part;

two printed circuit boards disposed in and positioned by the housing;

a metallic gasket assembled to a front mating portion of the housing;

a metallic holder assembled to a rear body portion of the housing, the upper and lower shield parts bound by the metallic gasket and the metallic holder;

a strain relief sandwiched by the first and second shield parts; and an engaging piece fastening the metallic holder to the strain relief.

11. The electrical connector assembly as recited in claim 9, wherein the gasket defines two lower walls, and the housing has two positioning sections engaged with the two lower walls.

12. An electrical connector assembly comprising:

a housing essentially formed by a pair of shield parts stacked with each other in a vertical direction to commonly define a receiving room wherein a front portion of the housing is defined by only one of the shield parts to form a frame structure as a mating port communicating with an exterior in a front-to-back direction;

a pair of printed circuit boards with a spacer sandwiched therebetween in a vertical direction perpendicular to said front-to-back direction to commonly received in the receiving room;

each of said pair of shield parts including a post on an interior face to support the corresponding printed circuit board in the vertical direction, and a recess in said interior face open in the vertical direction to allow a side protrusion of the corresponding printed circuit board to be assembled therein and move until reach a shoulder of said recess so as to prevent the corresponding printed circuit board from moving in the front-to-back direction.

13. The electrical connector assembly as claimed in claim 12, wherein said spacer includes a side protrusion to be assembled into the recess similar to that of the printed circuit board.

14. The electrical connector assembly as claimed in claim 12, wherein another post is formed on the interior face around said recess to be received in a corresponding notch formed in the side protrusion of the corresponding printed circuit board.

15. The electrical connector assembly as claimed in claim 14, wherein said spacer includes a side protrusion to be assembled into the recess similar to that of the printed circuit board.

16. The electrical connector assembly as claimed in claim 15, wherein said spacer includes a notch in the correspond side protrusion to be received in said another post.

17. The electrical connector assembly as claimed in claim 12, wherein the spacer defines a pair of raised ribs on two sides where the side protrusions are located.

* * * * *